United States Patent [19]

Ariga et al.

[11] 4,195,249

[45] Mar. 25, 1980

[54] FLAT TYPE OF FLUORESCENT LAMP

[75] Inventors: Kazuo Ariga, Tokyo; Norimasa Oinuma, Machida; Mitunari Yoshida, Tokyo, all of Japan

[73] Assignee: Stanley Electric Co., Ltd., Tokyo, Japan

[21] Appl. No.: 937,920

[22] Filed: Aug. 30, 1978

[51] Int. Cl.[2] ..... H01J 61/32; H01J 61/36; H01J 61/42

[52] U.S. Cl. ..... 313/493; 313/318

[58] Field of Search ..... 313/493, 49, 51, 318, 313/331, 517

[56] References Cited

U.S. PATENT DOCUMENTS

| | | | |
|---|---|---|---|
| 2,745,982 | 5/1956 | Breadner et al. | 313/493 X |
| 3,327,153 | 6/1967 | Bickmire et al. | 313/517 X |
| 3,515,931 | 6/1970 | Takakuwa | 313/318 |
| 3,646,383 | 2/1972 | Jones et al. | 313/493 |
| 3,786,295 | 1/1974 | Fujii et al. | 313/517 |
| 4,039,882 | 8/1977 | Kupsky et al. | 313/318 X |

*Primary Examiner*—Palmer C. Demeo

*Attorney, Agent, or Firm*—Frishauf, Holtz, Goodman and Woodward

[57] ABSTRACT

A flat type of fluorescent lamp having a pair of shells. One of the shells has a surface which extends outwardly from the joint portion of the shells, at both ends thereof. A pair of lead-in wires for supporting a discharge electrode are disposed on the outwardly extending surface of the shell and are connected to electrode terminals which correspond to the pair of lead-in wires.

6 Claims, 11 Drawing Figures

FIG_9
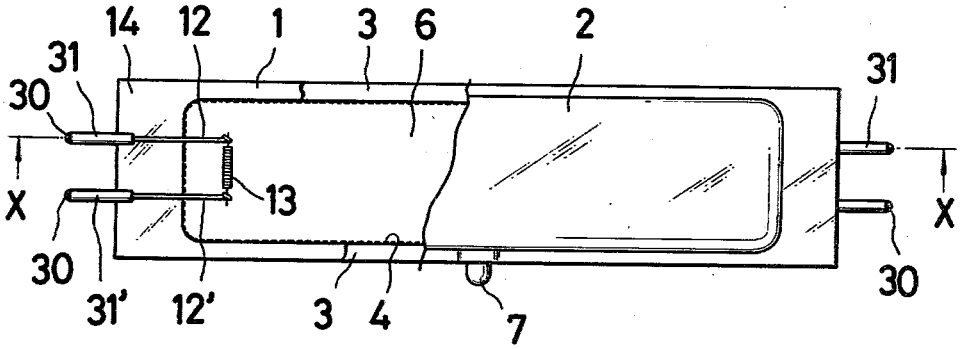
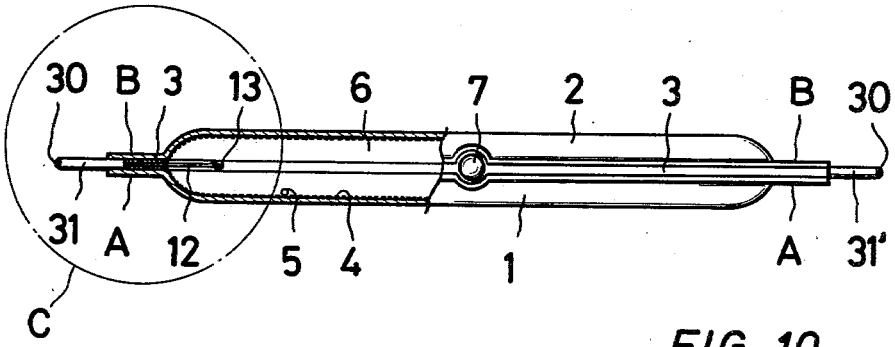
FIG_10
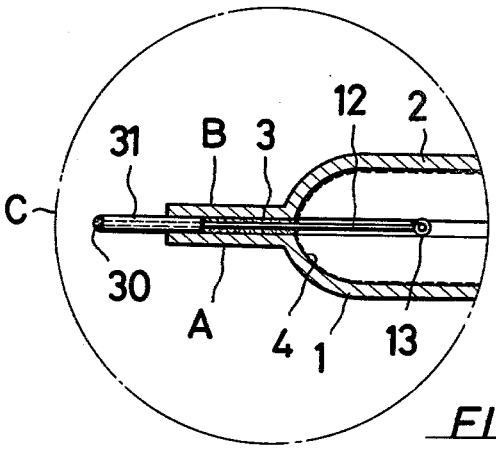
FIG_11

FLAT TYPE OF FLUORESCENT LAMP

BACKGROUND OF THE INVENTION

The present invention relates to a fluorescent lamp and more particularly to a flat type of fluorescent lamp having a pair of shells.

DESCRIPTION OF THE PRIOR ART

At present, the main current in artificial light sources is occupied by fluorescent lamps which are better than other light sources in luminous efficiency. However, such fluorescent lamps still possess some problems. That is, present fluorescent lamps have, in general, cylindrical tube shape. In order to obtain uniform illumination, such fluorescent lamps require a reflecting device combined therewith and therefore require a wide space for its incorporation. Further, in such fluorescent lamps, because the electrode terminals are constituted by pins, its structure is weak against vibration and its mounting is inconvenient.

In order to solve the above mentioned defects of the conventional fluorescent lamp, it is an object of the invention to provide a flat type of fluorescent lamp which can obtain uniform illumination.

It is another object of the invention to provide a flat type of fluorescent lamp which has electrode terminals of flat plate-like shape, is simple in its structure and is easy to manufacture.

SUMMARY OF THE INVENTION

With the present invention, a flat type of fluorescent lamp comprises a pair of shells including a base shell and a cover shell, a peripheral joint portion provided on the shells and joined to each other by means of solder glass so as to form a sealed body, a plate-like surface extending outwardly from both longitudinal ends of the peripheral joint portion of the base shell, a pair of lead-in wires disposed on the outwardly extending plate-like surface and extending through sealed body supporting a discharge electrode, therewithin and electrode terminals corresponding to the pair of lead-in wires and disposed on the outwardly extending surface.

BRIEF DESCRIPTION OF THE DRAWINGS

FIG. 9 is a plan view in partial section showing a further embodiment of the invention;

FIG. 10 is a side elevation in partial section taken on line X—X in FIG. 9; and FIG. 11 is an enlarged cross-sectional view of the area in circle C in FIG. 10.

DETAILED DESCRIPTION OF PREFERRED EMBODIMENTS

Figure 1:
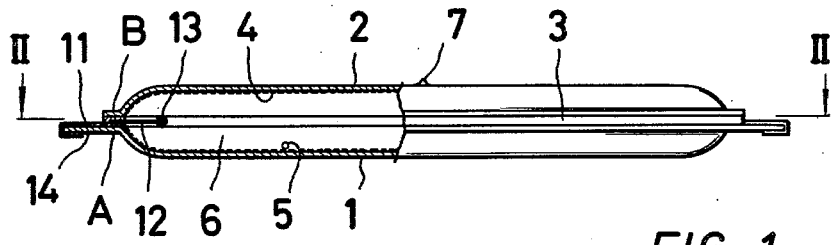
FIG. 1 is a side elevation in partial section showing an embodiment of the invention, having cross-sectional portion taken on line I—I in FIG. 2.
Figure 2:
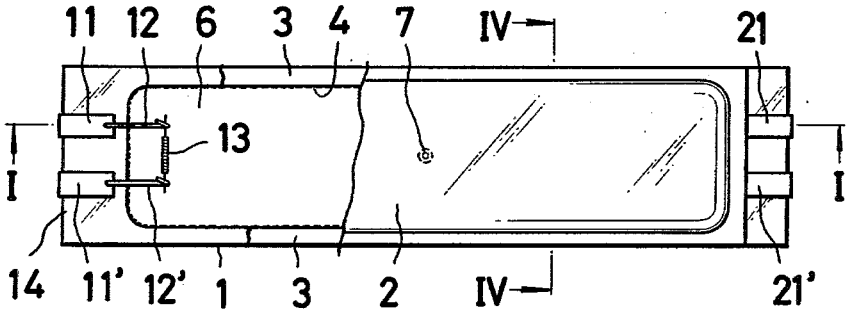
FIG. 2 is a plan view in partial section of the embodiment shown in FIG. 1, having a cross-sectional portion taken on line II—II in FIG. 1.
Figure 3:
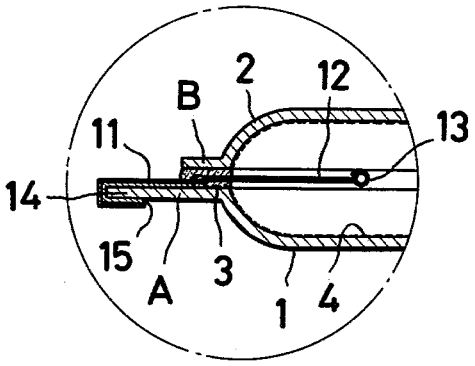
FIG. 3 is an enlarged view of the cross-sectional portion shown in FIG. 1.
Figure 4:
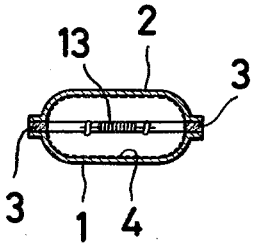
FIG. 4 is a cross-sectional view taken on line IV—IV in FIG. 2.

Referring to FIGS. 1 to 4, there is shown a flat type of fluorescent lamp which is formed by a base shell 1 and a cover shell 2. The shells 1 and 2 having a bowl shape are provided with joint portions A and B on a flat surface coinciding each other at their peripheries. At the joint portions, the shells are joined by means of solder glass 3 so as to form a sealed body. The base shell 1 is provided with a plate-like surface 14 extending outwardly from the joint portion A at longitudinal ends thereof. A discharge electrode 13 is held and connected by pairs of lead-in wires 12, 12' and 21, 21' at each respective end of the sealed body. At the plate-like surface 14 extending outwardly from the sealed body, the lead-in wires 12 and 12' are connected to metal ribbons 11 and 11' which adhere to the plate-like surface 14 by means of adhesive 15. These metal ribbons form electrode terminals and extend from the top side surface of the plate-like surface to its back surface. A discharge electrode of the opposide side not shown is connected to metal ribbons 21 and 21' forming electrode terminals in the same construction as that mentioned above. Fluorescent material 4 is applied to form a film inside of the sealed body. In the sealed body is sealed a proper quantity of mercury 5 and argon gas 6 of the desired pressure, and exhaust tube 7 is tipped off at a tip off portion 7 which is near the center portion of the cover shell 2.

In manufacturing the flat type of fluorescent lamp mentioned above, first, the solder glass is applied to the joint portions A and B of the base shell 1 and of the cover shell 2 on inner surfaces to which the fluorescent material is being applied. The lead-in wires 12 and 12' have the electrode 13 pinch-connected previously to each one end thereof, and at the other end, are spot-welded to the ribbons of nickel foil in such a manner that a mount having a desired shape and dimension is formed. The lead-in wires of the mount formed as mentioned above is mounted on the solder glass applied on the joint portion of the one end of the base shell. In this case, a mount formed in the same manner as that of the above mount is also mounted on the solder glass applied to the joint portion of the other end of the base shell 1. The joint portion B of the cover shell 2 covered by the solder glass is rested on the joint portion of the base shell 1 having the condition mentioned above so as to coincide with each other. The shells 1 and 2 are placed in an inert atmosphere while holding the coinciding condition and are heated and burned to obtain an entirely sealed body by hardening the solder glass. For example, this sealed body may be easily produced by heating glass plate in the inert atmosphere with a carbon mold. Second, free ends of the metal ribbons welded to the lead-in wires are adhered to the plate-like surface of the base shell 1 by means of adhesive. These metal ribbons are used as electrode terminals. In this embodiment, the metal ribbons are turned back toward the back surface at the extreme end of the plate-like surface. After this, by the well known method, the air in the sealed body is exhausted through an exhaust tube 7 provided in the center portion of the cover shell 2 and the mercury 5 and argon gas 6 are enclosed in the sealed body. Finally, the exhaust tube is tipped off to complete the flat type of fluorescent lamp according to the invention.

Figure 5:
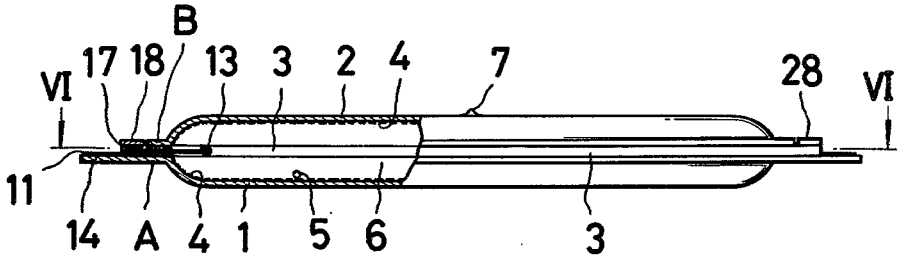
FIG. 5 is a side elevation in partial section showing other embodiment of the invention, having cross-sectional portion taken on line V—V in FIG. 6.
Figure 6:
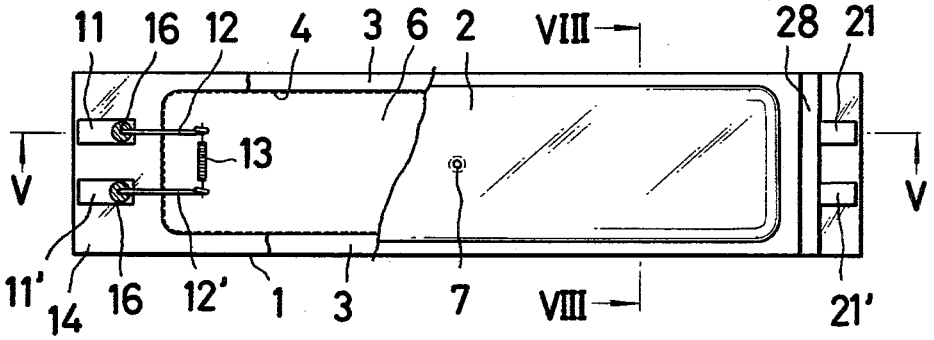
FIG. 6 is a plan view in partial section of the embodiment shown in FIG. 5, having cross-sectional portion taken on line VI—VI in FIG. 5.
Figure 7:
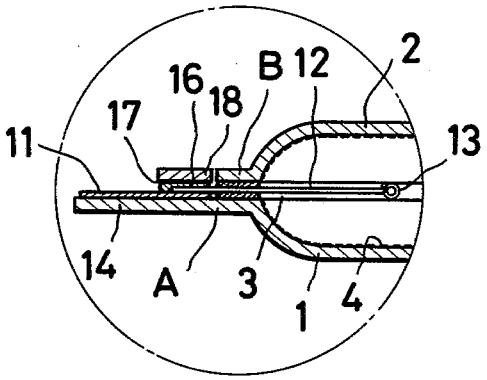
FIG. 7 is an enlarged view of the end portion of the cross-sectional portion shown in FIG. 5.
Figure 8:
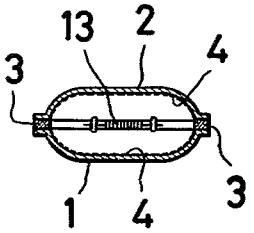
FIG. 8 is a cross-sectional view taken on line VIII—VIII in FIG. 6.

Referring to FIGS. 5 to 8, there is shown another embodiment of the flat type of fluorescent lamp according to the invention. In this embodiment, since its structure is generally similar to that of the embodiment shown in FIGS. 1 to 4, its detailed description is abbreviated herein. Reference numerals in the Figures show the same parts as or the corresponding parts to that shown in FIGS. 1 to 4.

In this embodiment, metal ribbons 11, 11', 21 and 21' are made of ribbon-like conductive paint printed and burned on the plate-like surface of the base shell 1 and constitute electrode terminals. Further, as seen from the enlarged sectional view in FIG. 7, the lead-in wires 12 and 12' are adhered to the electrode terminals 11 and 11' by means of conductive adhesive 16. An upper surface of the conductive adhesive 16 is covered by stationary frames 18 and 28 of insulating material adhered by insulative adhesive 17, such as epoxy resin or silicon rubber.

Referring to FIGS. 9 to 11, there is shown a further embodiment of the flat type of fluorescent lamp according to the invention. In this embodiment, lead-in wires 12 and 12' extend through lead-in pins 31 and 31' and are soldered at outer ends 30 and 30', instead of adhering to the metal ribbons as mentioned above. The other structure and manufacturing processes are substantially similar to the previously mentioned embodiments and therefore the detailed description is abbreviated.

As understood from the above descriptions, the flat type of fluorescent lamp can be very easy produced in accordance with the invention. Better illumination can be obtained because of the better orientation of light with the flat type of fluorescent lamp. The electrode terminals are planarly attached to the plate-like surface on the ends of the sealed body which itself constitutes the itself lamp body and therefore the flat type of fluorescent lamp is simple and easy in mounting on a lighting device. Since the sealed body itself is provided with the electrode terminals, the fluorescent lamp has excellent vibration resistance and other mechanical strength when mounted.

Since the flat type of fluorescent lamp according to the invention has effects as mentioned above, its application is not limited to general illuminating devices and can be used by simply fixing to an IC socket.

While the invention has shown and described certain present preferred embodiments it is to be distinctly understood that the invention is not limited thereto but may be otherwise variously embodied within the scope of the following claims.

What is claimed is:

1. A flat fluorescent lamp comprising first and second elongated shells, each shell having peripheral joint portions adapted to be sealed together, each of said first and second shells having depths substantially less than the distance between opposing joint portions;

means for sealing said peripheral joint portions of said elongated shells together so that said elongated shells form a sealed elongated hollow body;

at least two rigid plate-like surfaces projecting outwardly from respective opposite ends of said sealed elongated hollow body, said plate-like surfaces extending from one of said elongated shells;

at least two pairs of conductors, each pair extending from a respective one of said plate-like surfaces at said respective opposite ends of said elongated sealed hollow body to within said sealed hollow body;

a discharge electrode supported by and electrically connected between the conductors of each pair of said conductors and being located within said sealed elongated hollow body and defining a substantially linear discharge path therebetween; and at least two pairs of flat metallic strips, each pair of flat metallic strips being adhesively mounted on a respective one of said plate-like surfaces at respective ends of said sealed elongated hollow body and electrically connected to the respective conductors of the corresponding pair of said wires.

2. The flat fluorescent lamp of claim 1, wherein said conductors are spot-welded to said flat metallic strips.

3. The flat fluorescent lamp of claim 1, wherein said flat metallic strips are areas of electrically conductive paint on the respective plate-like surfaces.

4. The flat fluorescent lamp of claim 1 or 3, comprising an electrically conductive adhesive electrically connecting said conductors to said flat metallic strips.

5. The flat fluorescent lamp of claim 4, comprising an insulator covering said electrically conductive adhesive.

6. The flat fluorescent lamp of claim 5, comprising an insulating adhesive mounting said insulator to said electrically conductive adhesive.

* * * * *